US007165681B2

(12) United States Patent
Neuhaeusler

(10) Patent No.: US 7,165,681 B2
(45) Date of Patent: Jan. 23, 2007

(54) DEVICE AND METHOD FOR SORTING OF BENT ELONGATED ARTICLES

(75) Inventor: Wolfgang Neuhaeusler, Altenstadt (DE)

(73) Assignee: Wieland-Werke AG, Ulm (DE)

( * ) Notice: Subject to any disclaimer, the term of this patent is extended or adjusted under 35 U.S.C. 154(b) by 69 days.

(21) Appl. No.: 11/002,690

(22) Filed: Dec. 2, 2004

(65) Prior Publication Data

US 2005/0126959 A1 Jun. 16, 2005

(30) Foreign Application Priority Data

Dec. 12, 2003 (DE) ..... 103 58 124

(51) Int. Cl.
*B07C 5/12* (2006.01)

(52) U.S. Cl. ..... 209/518; 209/520; 209/601

(58) Field of Classification Search ..... 209/518, 209/520, 598, 592, 600, 601, 649, 696
See application file for complete search history.

(56) References Cited

U.S. PATENT DOCUMENTS 2,611,484 A * 9/1952 Sawyer et al. ..... 209/557
2,765,076 A * 10/1956 Casler et al. ..... 209/598
2,781,905 A * 2/1957 Phillips ..... 209/518
3,133,639 A 5/1964 Spier et al.
3,710,935 A 1/1973 Heiser
4,155,549 A * 5/1979 Mims ..... 209/645
5,292,007 A * 3/1994 Beer et al. ..... 209/518

FOREIGN PATENT DOCUMENTS

DE 35 01 725 C1 7/1986
EP 0 162 188 10/1988

* cited by examiner

*Primary Examiner*—Joseph C. Rodriguez
(74) *Attorney, Agent, or Firm*—Flynn, Thiel, Boutell & Tanis, P.C.

(57) ABSTRACT

A device for sorting bent elongated articles, in particular rods or tubes, having a measuring span with an inclined plane, down which the articles roll. A separating system provided at the outlet end of the measuring span sorts the bent articles from the straight articles, whereby a pressure gauge is arranged in the measuring span in order to determine the force of the rolling-off articles onto the inclined plane. The measured force of the rolling-off articles in the measuring span is evaluated regarding a curvature and the articles are sorted by the evaluated signal through the separating system.

17 Claims, 5 Drawing Sheets

DEVICE AND METHOD FOR SORTING OF BENT ELONGATED ARTICLES

FIELD OF THE INVENTION

The invention relates to a device for sorting of bent elongated articles which has a measuring span with an inclined plane down which the articles roll, and a separating system provided at the outlet end of the measuring span for sorting of the bent articles from the straight articles. The invention relates furthermore to a corresponding method for sorting of bent articles.

BACKGROUND OF THE INVENTION

At the end of the manufacturing process of rods and tubes of metal, these have to be examined regarding straightness. Rods which are not straight could, for example, during further processing in automatic lathes cause damage to the machine due to their unbalanced mass. Methods known up to now which determine the straightness are based, for example, on measuring rolling-off times on a sloped plane or on optical measuring with the aid of laser scanners or CCD cameras.

Thus a method for sorting of bent rods, tubes or the like is known from the Reference DE 35 01 725 C1, where it is suggested to place the respective articles on a sloped plane with a specified angle of inclination and to detect the rolling-off operation via a time interval. If a bent tube rolls off too slowly within the specified time interval, a rocking bar provided at the outlet end of the sloped plane is operated and the tube is sorted out into a further container for waste. The rods which, due to their straightness, roll sufficiently quickly down the plane, are collected in a separate storage container.

Also a method for measuring the curvature of cylindrical bodies is known from the Reference U.S. Pat. No. 3,710,935, where contact elements are arranged below a rolling plane, which contact elements detect a curvature. If the body to be examined has a curvature which is too great, it contacts the contact elements while rolling down the sloped plane, whereby said body is then sorted out. The parts to be examined in this manner must, of course, have a high flexural resistance since otherwise no reproducible measuring results can be achieved. Thus such a method is of limited use in the examination of long and in particular thin rods.

SUMMARY OF THE INVENTION

The basic purpose of the invention is to improve a device and a method for sorting of bent articles so that these can be examined reliably regarding quality in particular at greater lengths or smaller diameters.

The invention is disclosed regarding the device by the characteristics of claim 1 and regarding the method by the characteristics of claim 12. The further dependent claims disclose advantageous embodiments and further developments of the invention.

The invention includes the technical teaching that the device for sorting of bent elongated articles has a measuring span with an inclined plane, on which the articles roll off, and a separating system provided at the outlet of the measuring span for sorting of the bent articles from the straight articles, whereby a pressure gauge is arranged in the measuring span in order to determine the force of the rolling-off articles onto the inclined plane. The device for sorting is suited in particular for metal rods and tubes.

The invention is thereby based on the thinking that due to the non-straightness of a rod the center of gravity of said rod shifts away from the theoretical centerline. This shift in the center of gravity creates during the rolling off of the rod a sinusoidal force, which increases with the increase of the angular velocity through the movement on the inclined plane. Since the rods, caused by the system, roll off over an inclined plane, it is not necessary to rotate the rods via an external drive. The force, which a rod applies onto the inclined plane, is detected by a force-measuring system and is prepared by an evaluating system so that the weight force of the rod is subtracted from the detected signal and the force component produced by the unbalanced mass remains thereby as measuring signal. This force component has, measured over time, a sinusoidal course. The starting process of a measurement can occur either through an optic detecting system or, when electrically conducting articles are used, also electrically in that the article short-circuits a low-voltage circuit through the contact with the inclined plane.

The advantages achieved with the invention consist in particular in a reliable sorting of curved rods with a long length and a small diameter which can be judged from the evaluated measuring signal also over the entire length. Often occurring bent areas at the ends of a rod are thereby recognized just like unevennesses distributed over a rod. The signal detection and evaluation is thereby sufficiently exact in order to detect even short-wave unevennesses of rods. The throughput and thus the production output are in addition increased through a quick data logging. Further advantages result also for larger diameters of the articles to be examined. Aside from the otherwise usual rod dimensions with diameters of 2–28 mm and a length of up to 3 m, it is possible to sort dimensions of more than 30 mm. It is thereby possible to utilize alloys with varying hardnesses without further precautions with regard to their stability against deformations.

The inclined plane can in a preferred embodiment consist of at least two rolling-off bars, which are spaced from one another, and which transmit the force of the rolling-off articles to at least one pressure gauge. It is advantageous to provide several rolling-off bars for long, thin rods in order to sufficiently support the rods over their entire length. A pressure gauge can thereby be mounted on all rolling-off bars. This offers in particular the advantage to view the action of the force occurring due to a local curvature of a rod section. However, in most cases it is sufficient to obtain also reliable measuring signals when a force measurement is carried out merely at a few rolling-off bars.

However, it is also of a particular interest to detect the curvature of an article in its entirety. The rolling-off bars can in a preferred embodiment be mounted on a supporting frame, whereby a pressure gauge can be arranged below the frame. The force acting onto the rolling-off bars thus acts through the frame centrally onto the pressure gauge. The frame combines all forces acting onto the rolling-off bars into one resulting force, which is in this manner detected and evaluated by a force-measuring unit. A particularly simple solution with little measuring-technical input is achieved in this manner.

Articles having varying dimensions in length and in diameter are often being produced. In order to adapt a device to the production-technical conditions, it is possible to advantageously vary the distance between the rolling-off bars. By adapting the distance, a rod is supported at an optimum and a sagging is avoided.

The curvature of a rod-shaped article can be detected only by the force resulting from a rolling-off operation, which force is created by an acentric position of the center of gravity of the rod. When a rod with multiple bends rolls down the rolling-off bars so that possibly, incidentally, the center of gravity of the rod lies centrally with respect to the support points, then an action of force on the inclined plane does not result therefrom. The rolling-off bars can therefore be arranged in a preferred embodiment at a specifiable acute angle to one another. The support points are thus changed during the rolling-off operation over the length of the rod so that, in the case of bent rods, the center of gravity is moved at least temporarily into an acentric position, and a measuring signal representative of the quality of the rod is created therefrom. The article can in this manner be examined over its entire length.

The angle of inclination of the inclined plane can advantageously be adjusted. In order to be able to measure the additional action of the force of a bent article early, which force is added to the weight force, the articles should start to move sufficiently quickly. The inclination over the rolling-off span can vary for this purpose. The higher acceleration will be achieved at a variable inclination in such a manner that the angle of inclination is chosen larger at the start of the rolling-off span than at the end.

The inclined plane can alternatively in a preferred embodiment be designed as a sloped plane with a constant angle of inclination $\alpha$. The angle of inclination can advantageously be $\alpha$=0.5° to 20°, preferably 1° to 5°. The angle of inclination is chosen in such a manner that the article to be tested receives a sufficient speed in order to obtain a reliable measurement for given quality standards.

An acceleration distance can advantageously be arranged in front of the measuring span. Thus the article to be tested enters into the measuring span only when it has already reached a sufficient speed.

A preferred embodiment of the invention provides that for a reliable sorting of curved articles to be tested, the separating system can be a rocking bar at the outlet end, which rocking bar can be adjusted between a normal position and an ejecting position. The normal position causes, for example, that straight articles roll over and beyond the closed rocking bar into a storage container for good quality, and bent articles are separated through an opening of the rocking bar into a second container for waste. This rocking bar can also consist of spaced-apart bars.

If the articles have a significant curvature, then these can also remain lying on the inclined plane. Movable carriers can advantageously be arranged on the inclined plane, which carriers remove articles left behind. The carriers can be pegs moving in direction of inclination of the inclined plane, which pegs project beyond the upper edge of the bars and are mounted on a band or a chain circulating below the upper edge of the bars.

A further aspect of the invention suggests a method for sorting of bent elongated articles, in particular of rods or tubes, where an article to be examined rolls off on a measuring span with an inclined plane, whereby the force of the articles rolling-off onto the inclined plane is measured in the measuring span and is evaluated regarding a curvature, and the articles are sorted by means of the evaluated signal through a separating system provided at the outlet end of the measuring span.

The distance between the support points of the article is advantageously varied with the inclined plane. This can be accomplished either by a reduction in the distance between rolling-off bars extending parallel to one another or by a V-shaped arrangement.

In order to fix the start of an examination interval in the evaluating unit, a measurement of the force is in a preferred embodiment started after an initial signal triggered by the article. Also it is possible to fix the end of a measurement regarding the leaving of the article from the inclined plane.

The angle of inclination of the inclined plane is varied in a preferred embodiment of the invention. A variation can be a change of the angle of inclination over a certain area at the start of the inclined plane. This area can possibly be the acceleration distance.

An article, which does not roll off due to its large curvature, is advantageously moved on by a carrier. The articles moved on in this manner are, as a precaution, considered to be waste and are sorted accordingly.

BRIEF DESCRIPTION OF THE DRAWINGS

Exemplary embodiments of the invention will be discussed in greater detail in connection with schematical drawings, in which.

DETAILED DESCRIPTION OF THE PREFERRED EMBODIMENT

Figure 1:
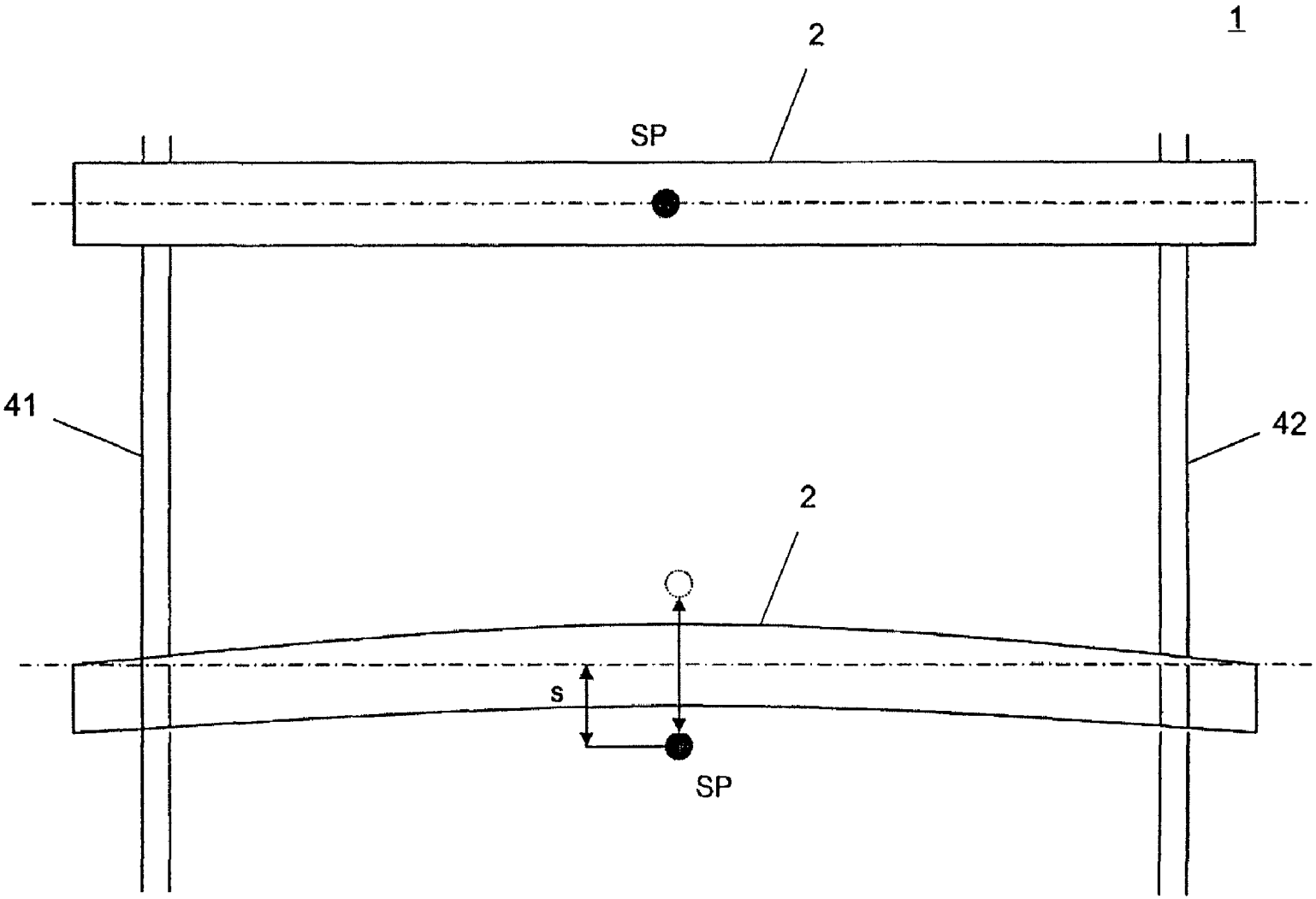
FIG. 1 schematically illustrates a rolling-off operation of a straight and a bent rod, FIG. 2 schematically illustrates a rolling-off operation of a bent rod in relationship to a rolling-off bar.

Corresponding parts are identified with the same reference numerals in all figures.

FIG. 1 schematically illustrates a rolling-off operation of a straight (upper half of illustration) and a bent (lower half of illustration) rod 2 on two rolling-off bars 41 and 42. The center of gravity SP is in the case of a straight rod 2 on the axis, which runs through the center of the rod. The center of gravity shifts during rolling off merely parallel to the inclined plane in linear direction. The center of gravity shifts in the case of a bent rod away from the theoretical centerline of the rod. Consequently the rod 2 produces during rolling off a sinusoidal force, which acts in addition to the weight force onto the rolling-off bars 41 and 42, and which increases with an increase of the angular velocity. The inclination of the inclined plane 4 is chosen in such a manner that a rod 2 starts to rotate without an external drive.

Figure 2:
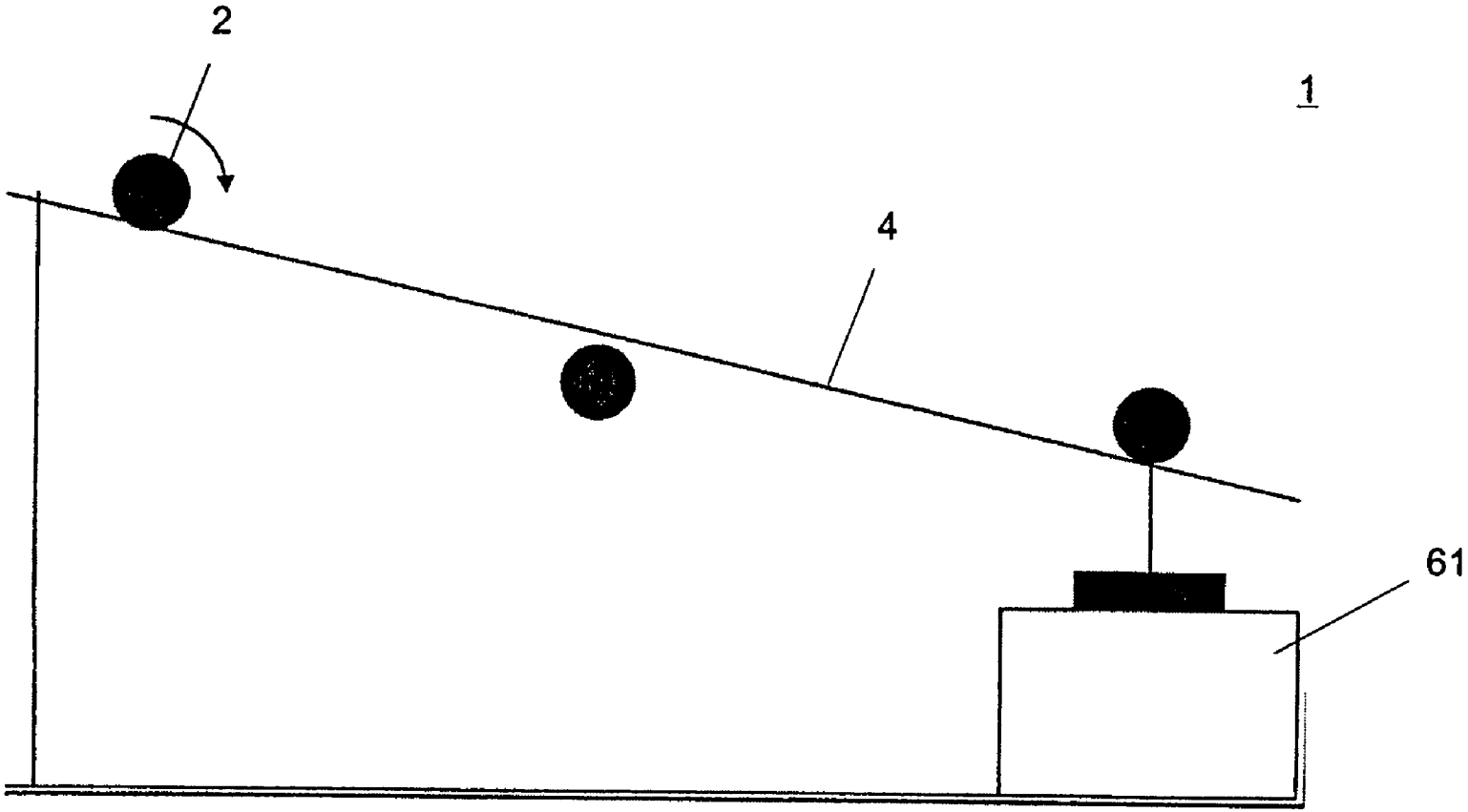

When the force, which acts onto the inclined plane, as is illustrated in FIG. 2, is measured with a pressure gauge 61 and the weight force of the rod is subtracted from the measuring result, then there remains a force component which changes sinusoidally with the rotation of the rod.

Figure 3:
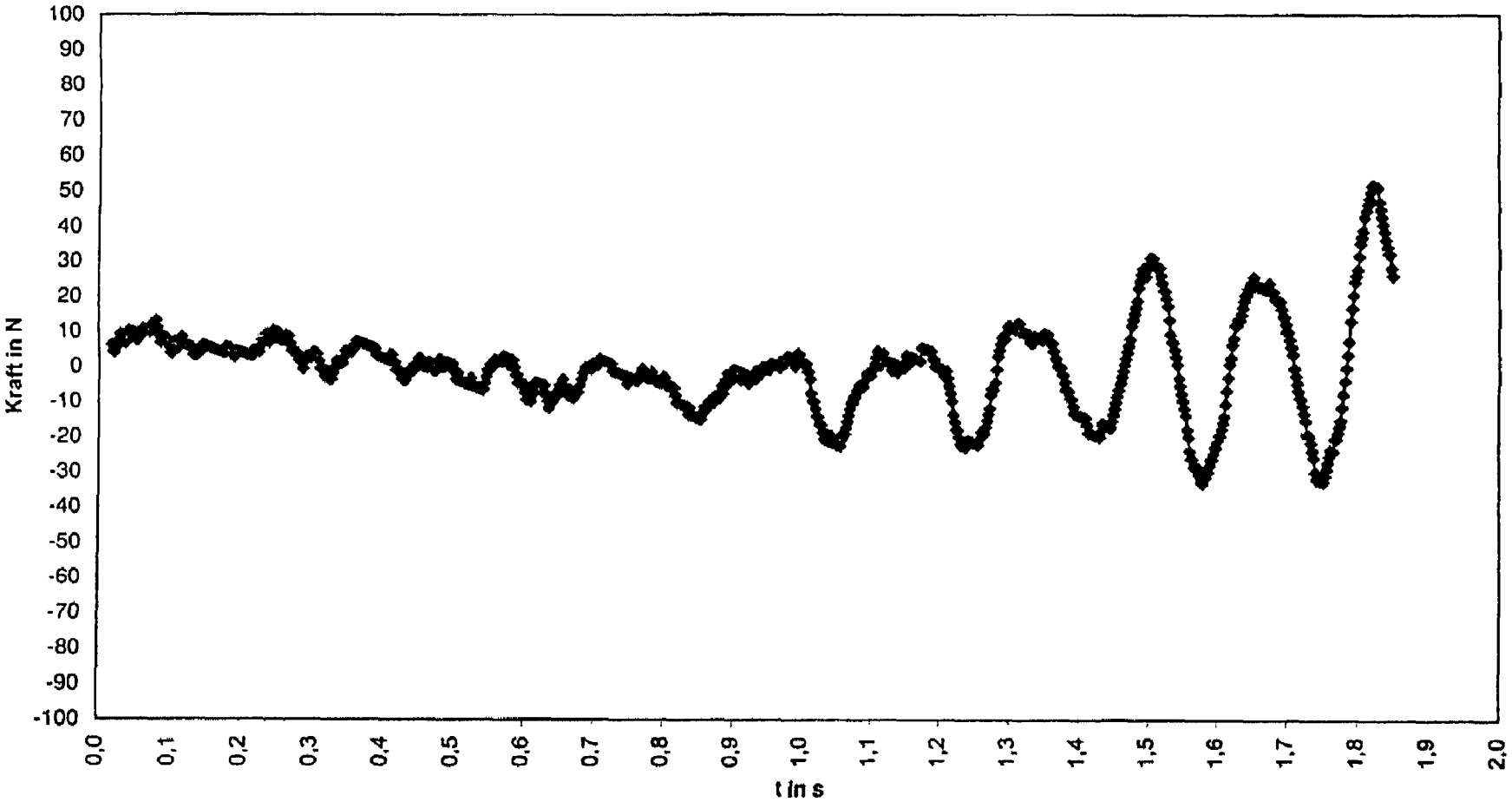
FIG. 3 illustrates a measuring diagram of the force, which additionally acts onto the inclined plane through a rolling-off operation, in a time slope.

FIG. 3 illustrates such a measuring diagram of the force, which additionally acts onto the inclined plane 4 through a rolling-off operation, in a time slope. The weight of the rod has in this illustration already been calculated.

Figure 4:
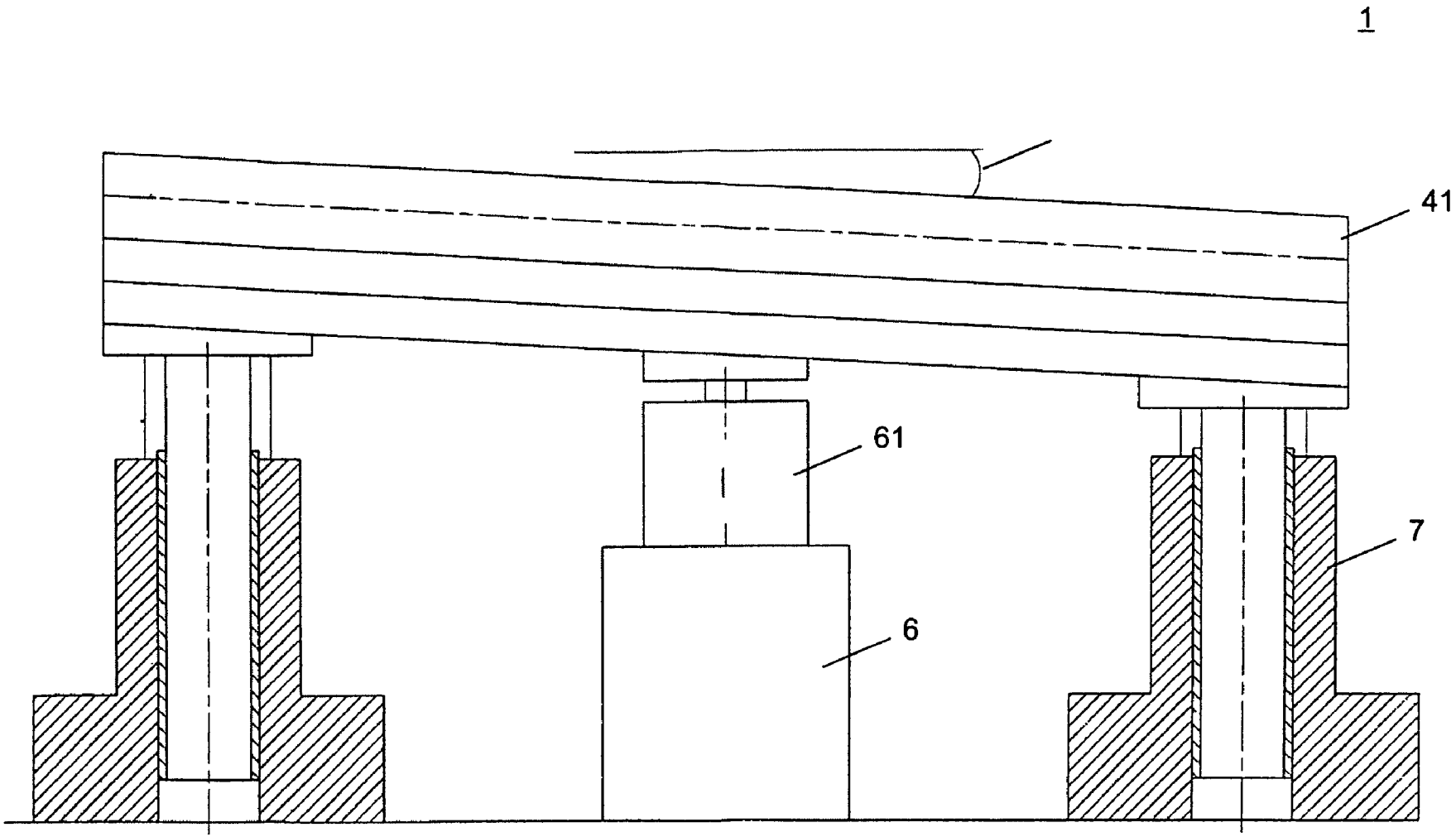
FIG. 4 is a schematic cross-sectional view of a rolling-off bar with a force-measuring unit.

FIG. 4 is a schematic cross-sectional view of a rolling-off bar 41 or 42 with a force-measuring and evaluating unit 6.

The angle of inclination a of the rolling-off bar is thereby variably adjustable. The rolling-off bar 41 or 42 is mounted through a support and guide unit 7 in the form of a linear guide so that essentially no vertical forces can be transmitted onto same. The entire force resulting from a rolling-off operation of a rod is transmitted to the pressure gauge 61 arranged below the rolling-off bar 41 or 42. The measuring signal is suitably further processed by an evaluating unit.

FIG. 4 is a schematic cross-sectional view of a rolling-off bar 41 or 42 with a force-measuring unit 61 and an evaluating unit 6. The angle of inclination $\alpha$ of the rolling-off bar is variably adjustable. The rolling-off bar 41 or 42 is mounted through a support and guide unit 7 in the form of a linear guide so that essentially no vertical forces can be transmitted onto same. The entire force resulting from a rolling-off operation of a rod is transmitted to the pressure gauge 61 arranged below the rolling-off bar 41 or 42. The measuring signal is suitably further processed by the evaluating unit.

Figure 5:
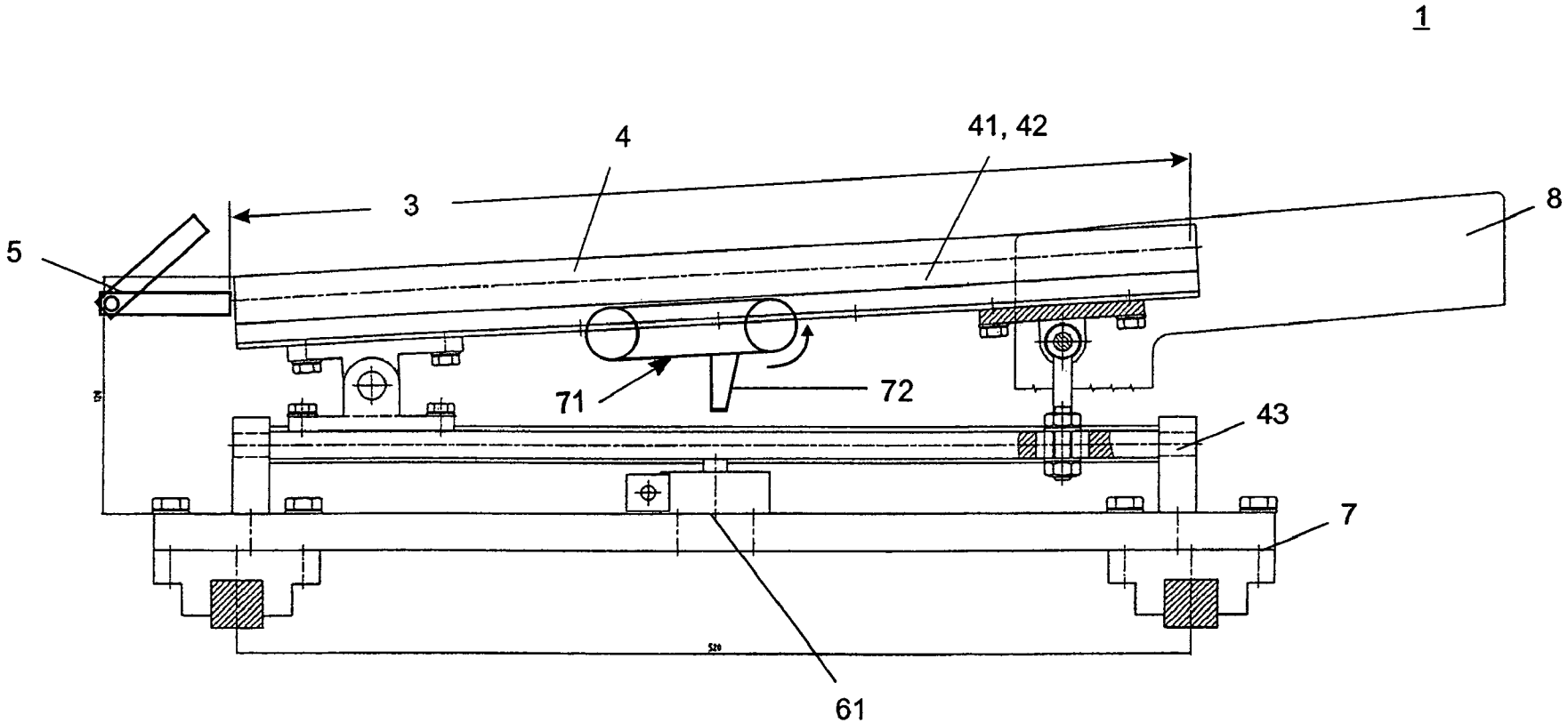
FIG. 5 is a schematic cross-sectional view of a sorting device with a supporting frame for the central introduction of force.

A further embodiment of the invention is illustrated in FIG. 5. FIG. 5 is a schematic cross-sectional view of a sorting device 1 with a frame 43 for the central introduction of force. This device is also suited to connect several rolling-off bars 41 and 42 through the supporting frame 43 and to introduce the force resulting therefrom centrally into a pressure gauge 61 mounted below the frame. The frame 43 in turn is connected to a support and guide unit 7 so that the vertical force essentially acts only onto the pressure gauge 61. The support and guide unit 7 serves thereby to laterally stabilize the frame 43. Also an acceleration distance 8 is indicated in FIG. 5, which usually is not directly connected to the rolling-off bars 41 and 42. When using an acceleration distance 8 the articles 2 are included in the measured-value logging only at a certain speed. Thus it is possible to log measuring data for a rod 2 in the measuring range, and it is possible at the same time for the next rod to assume speed on the acceleration distance 8. This leads to a shortening of the data logging needed for the judging of a rod and thus to an increased throughput of rods.

The separating system 5 is provided at the end of the inclined plane, which separating system in the open position sorts out bent rods. The separating system 5 can be a rocking bar 5 at the outlet end, which rocking bar can be adjusted between a normal position and an ejecting position as shown in FIG. 5.

Movable carriers 71 shown in FIG. 5 can be advantageously arranged on the inclined plane, which carriers remove articles left behind. The carriers have pegs 72 for moving in direction of inclination of the inclined plane, which pegs project beyond the upper edge of the bars and are mounted on a band or a chain circulating below the upper edge of the bars.

The invention claimed is:

1. A device for sorting of bent elongated articles, which has a measuring span with an inclined plane down which the articles roll, the inclined plane including at least two rolling-off bars spaced from one another; and a separating system provided at the outlet end of the measuring span for sorting of the bent articles from straight articles, wherein a pressure gauge is arranged in the measuring span in order to determine the force of the rolling-off articles transmitted thereto by the at least two rolling-of bars of the inclined plane.

2. The device according to claim 1, wherein the rolling-off bars are mounted on a supporting frame and the pressure gauge is arranged below the frame, which causes the force acting onto the rolling-off bars to act through the frame centrally onto the pressure gauge.

3. The device according to claim 1, wherein the distance between the rolling-off bars can be varied.

4. The device according to claim 1, wherein the rolling-off bars are arranged at a specifiable acute angle to one another.

5. The device according to claim 1, wherein the angle of inclination of the inclined plane is adjustable.

6. The device according to claim 1, wherein the inclined plane is a sloped plane with a constant angle of inclination $\alpha$.

7. The device according to claim 6, wherein the angle of inclination $\alpha$=0.5° to 20°.

8. The device according to claim 1, wherein an acceleration distance is arranged in front of the measuring span.

9. The device according to claim 1, wherein the separating system is a rocking bar adjustable between a normal position and an ejecting position.

10. The device according to claim 1, wherein movable carriers are arranged on the inclined plane.

11. The device according to claim 1, wherein the elongated articles comprise rods or tubes.

12. A method for sorting of bent elongated articles, where an article to be examined rolls down a measuring span with an inclined plane, wherein the force of the rolling-off articles onto the inclined plane is measured in the measuring span and is evaluated regarding a curvature, and the articles are sorted by means of an evaluated signal through a separating system provided at an outlet end of the measuring span.

13. The method for sorting of elongated articles according to claim 12, wherein the distance between support points of the article is varied with the inclined plane.

14. The method for sorting of elongated articles according to claim 12, wherein a measurement of the force is started after an initial signal caused by the article.

15. The method for sorting of elongated articles according to claim 12, wherein the angle of inclination of the inclined plane is varied.

16. The method for sorting of elongated articles according to claim 12, wherein an article, which due to a large curvature does not roll off, is moved on by a carrier.

17. The method for sorting of elongated articles according to claim 12, wherein the articles comprise rods or tubes.

* * * * *

UNITED STATES PATENT AND TRADEMARK OFFICE

CERTIFICATE OF CORRECTION

PATENT NO. : 7,165,681 B2
APPLICATION NO. : 11/002690
DATED : January 23, 2007
INVENTOR(S) : Wolfgang Neuhaeusler It is certified that error appears in the above-identified patent and that said Letters Patent is hereby corrected as shown below:

Column 6, line 6; change “rolling-of” to --rolling-off--.

Signed and Sealed this

Eleventh Day of September, 2007

JON W. DUDAS
*Director of the United States Patent and Trademark Office*